US007607758B2

(12) United States Patent
Hatasa et al.

(10) Patent No.: US 7,607,758 B2
(45) Date of Patent: Oct. 27, 2009

(54) INK JET PRINTING HEAD AND INK JET PRINTING APPARATUS USING THE SAME

(75) Inventors: Nobuyuki Hatasa, Kanagawa (JP); Kenjiro Watanabe, Tokyo (JP); Kimiyuki Hayasaki, Kanagawa (JP); Keiichiro Tsukuda, Kanagawa (JP); Takuya Hatsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 427 days.

(21) Appl. No.: 11/404,889

(22) Filed: Apr. 17, 2006

(65) Prior Publication Data

US 2006/0238558 A1 Oct. 26, 2006

(30) Foreign Application Priority Data

Apr. 22, 2005 (JP) ..... 2005-125197

(51) Int. Cl.
*B41J 2/14* (2006.01)
*B41J 29/393* (2006.01)
*B41J 2/175* (2006.01)

(52) U.S. Cl. ..... 347/50; 347/19; 347/86

(58) Field of Classification Search ..... 347/19, 347/86, 5, 20, 9–11, 50; 439/67
See application file for complete search history.

(56) References Cited

U.S. PATENT DOCUMENTS

| | | | |
|---|---|---|---|
| 4,630,078 | A | 12/1986 | Watanabe |
| 4,635,080 | A | 1/1987 | Watanabe |
| 5,175,565 | A | 12/1992 | Ishinaga et al. |
| 5,182,580 | A | 1/1993 | Ikeda et al. |
| 5,319,389 | A | 6/1994 | Ikeda et al. |
| 5,363,134 | A | 11/1994 | Barbehenn et al. |
| 5,675,366 | A | 10/1997 | Hayasaki et al. |
| 5,828,386 | A | 10/1998 | Okada et al. |
| 5,940,957 | A | 8/1999 | Goto et al. |
| 6,377,358 | B1 | 4/2002 | Hayasaki et al. |
| 6,471,321 | B1 | 10/2002 | Aono et al. |
| 6,481,823 | B1 | 11/2002 | Bauer et al. |

(Continued)

FOREIGN PATENT DOCUMENTS

| | | | |
|---|---|---|---|
| EP | 0 571 093 | A | 11/1993 |

(Continued)

OTHER PUBLICATIONS

Note: Counterpart U.S. patent also cited (see text of IDS).

*Primary Examiner*—Shih-Wen Hsieh
(74) *Attorney, Agent, or Firm*—Fitzpatrick, Cella, Harper & Scinto

(57) ABSTRACT

The printing head has connection terminals for performing an electrical connection of signals including drive signals of print elements by contacting connection terminals on an apparatus side when the head is mounted onto an ink jet printing apparatus. Connections of all terminals can be guaranteed by detecting contacts of a part of terminals. Among the terminals in the head, terminals whose distances from the connection terminals in the printing apparatus become maximum when a deviation occurred in the mounting are used as terminals for contact detection. For example, from among the connection terminals arranged in a planar area, which is rectangular-shaped, terminals positioned in corners are used as the terminals for the contact detection. When the contacts of these terminals are detected, the connections of all the terminals inside the area can be guaranteed.

8 Claims, 9 Drawing Sheets

U.S. PATENT DOCUMENTS

| | | | |
|---|---|---|---|
| 6,502,917 | B1 | 1/2003 | Shinada et al. |
| 6,648,445 | B2 | 11/2003 | Ishizawa et al. |
| 6,969,154 | B2 | 11/2005 | Takeuchi et al. |
| 2002/0112878 | A1 | 8/2002 | Ishizawa et al. |
| 2006/0238558 | A1 | 10/2006 | Hatasa et al. |
| 2007/0002087 | A1 | 1/2007 | Matsui et al. |
| 2007/0008382 | A1 | 1/2007 | Hatsui et al. |

FOREIGN PATENT DOCUMENTS

| | | | |
|---|---|---|---|
| EP | 0 997 297 | A | 5/2000 |
| EP | 1 219 437 | A | 7/2002 |
| JP | 6-91877 | | 4/1994 |
| JP | 11-99679 | | 4/1999 |
| JP | 3124696 | | 1/2001 |
| JP | 2001-322279 | | 11/2001 |
| JP | 2002-178490 | | 6/2002 |
| JP | 2002-198627 | | 7/2002 |

INK JET PRINTING HEAD AND INK JET PRINTING APPARATUS USING THE SAME

BACKGROUND OF THE INVENTION

1. Field of the Invention

The present invention relates to an ink jet printing head for ejecting liquids like ink and an ink jet printing apparatus which carries out a printing operation using the printing head. Apart from a general printing apparatus, a copying machine, a facsimile machine with a telecommunication system, a word processor and the like with a printing unit, or a multi-function printing apparatus combining these apparatuses can be adopted as a form of the ink jet printing apparatus.

2. Description of the Related Art

The ink jet printing apparatus is a printing apparatus adopting a so-called non-impact printing method, and is characterized by its capability of high speed printing, capability of printing on various print media, little noise generation at the time of printing, and the like. For this reason, the ink jet printing apparatus is widely adopted as an apparatus for undertaking printing operations in printers, copying machines, facsimile machines, word processors and the like.

Typical ink ejection methods in printing heads mounted on the ink jet printing apparatus include the one using electromechanical transducers like piezo elements and the one ejecting ink droplets due to an effect of heat generated by an irradiation of electromagnetic waves like lasers. However, those ejecting ink droplets due to an effect of film boiling by heating ink with electrothermal transducer elements having heat elements are widely used. In the ink jet printing heads of this form, the electrothermal transducer elements are provided in an inner side of an ink ejection opening and electric pulses, which become print signals, are supplied thereto to generate heat. Thermal energy is given to ink by this and by using bubble pressure at the time of ink foaming (at the time of boiling) generated by a phase change of ink at the time, printing to a printing medium is carried out by ejecting micro-droplets of ink from a minute ejection opening. The ink jet printing head generally has a nozzle for ejecting ink as a droplet for example, and an ink supplying system for supplying ink to this nozzle.

The printing apparatus with the ink jet printing head as described above is capable of outputting letters and images of high quality with low cost. The ink jet printing apparatus using a principle, in which the film boiling is generated in liquid and ink is ejected accompanied with bubble formation (generation, development, defoaming, and extinction), is particularly the mainstream of the ink jet printing apparatus. This is because such printing apparatuses have an advantage in that they are capable of carrying out color printing at low cost by using ink jet printing heads having an ejecting portion for ejecting color liquids such as cyan, magenta, and yellow inks, apart from a black ink as a black liquid.

Under a condition where higher speed and definition of printing are demanded, generally 64, 128, and even 256 or more of the ejection openings are now being provided in the ejecting portion in the ink jet printing head. Moreover, an arrangement density of the ejection opening is becoming 300 dpi, 600 dpi or more, where a notation "dpi" describes a number of the ejection openings per one inch, and is also being enhanced. The heat element as an electrothermal transducer arranged in the respective ones of these ejection openings forms bubbles due to film boiling by pulse drives in the order of a few μsec to 10 μsec, realizing high speed printing with high image quality by such a high frequency drive.

As one form of such an ink jet printing apparatus, the one using an ink jet printing head with an ejecting portion or an ink jet printing head integrating the ejecting portion and an ink container as a cartridge is available. In other words, this is a configuration (for example, Japanese Patent Application Laid-open No. 2001-322279) where the cartridge is attachable/detachable to/from a support unit (a carriage for mounting the printing head and making it scan printing media in a predetermined direction in a serial type printing apparatus) provided in the main body of the printing apparatus. A power supply wiring terminal and a ground wiring terminal both for applying power to the electrothermal transducer elements, and data terminal and the like for receiving and transmitting data for drive controlling the electrothermal transducer elements in response to printing data and the like, are provided in an ink jet printing head side and a printing apparatus side. These terminals contact with each other to electrically connect the ink jet printing head and the printing apparatus when the ink jet printing head is mounted.

However, when the ink jet printing head is not mounted in a normal position in the main body of the printing apparatus, contact of the terminals of the printing head with the terminals of the main body of the printing apparatus become insufficient and a normal drive of the ink jet printing head is not carried out. Moreover, in extreme cases, by inputting unexpected electric pulses to the printing head, there is a concern that an element substrate provided with the electrothermal transducer elements of the ink jet printing head and the like is being destructed.

Accordingly, detection of normal mounting before the electrical connection for carrying out printing operation is strongly desired. It can be considered to apply the one disclosed in Japanese Patent Application Laid-open No. 11-099679 (1999) as a configuration for carrying out such detection although it is not directly related to the ink jet printing apparatus. The configuration detects whether each of signal lines from a control substrate is inserted or not by calculating logical product between a heating control line and respective plural data lines, in print head for printing using a thermal transfer ribbon and the like.

However, the number of terminals for carrying out the electric connection described above also increases when multiple ejection openings are implemented with high density in the ejecting portion and furthermore, when use of an ink jet printing head provided with a plurality of ejecting portions corresponding to plural colors of ink are becoming mainstream. Therefore, an application of a technique disclosed in Japanese Patent Application Laid-open No. 11-099679 (1999) to detect the presence or absence of contacts of all terminals leads to a longer detection time. Moreover, since the number of wirings for a detection mechanism increases, there are problems in that upsizing of a substrate for mounting various elements and a printing head takes place and manufacturing cost increases.

SUMMARY OF THE INVENTION

Although it is possible to consider detecting the presence or absence of contacts for a part of terminals, this does not guarantee the contacts of all terminals. That is, in order to avoid the upsizing of the mounting of various elements and the printing head and the increase in manufacturing cost, and although it is favorable to detect the presence or absence of contacts of the part of terminals, it is highly desirable where it is possible to regard that the contacts of all terminals have been made by this detection of contacts of the part of terminals. To accomplish this, the present inventors have recognized that an appropriate determination of terminals used for the detection is the problem, which should be solved.

In other words, an object of the present invention is to provide a configuration for guaranteeing contacts of all terminals by detecting only the contacts between a part of terminals in the printing head side and in the printing apparatus side.

In a first aspect of the present invention, there is provided an ink jet printing head attachable/detachable to/from an ink jet printing apparatus, comprising:

an ejecting portion having ink ejection openings and elements for generating energy to eject ink from the ink ejection openings; and a plurality of connection terminals for carrying out an electrical connection of signals including drive signals of the elements by contacting a plurality of connection terminals in the ink jet printing apparatus when the head is mounted on a main body of the ink jet printing apparatus, wherein from among the plurality of connection terminals, at least two terminals whose distances from the connection terminals in the ink jet printing apparatus become maximum when a deviation occurred in the mounting, are used as terminals for detection to carry out a confirmation of contacts of all of the plurality of connection terminals.

In a second aspect of the present invention, there is provided an ink jet printing apparatus/to from which the above ink jet printing head is attachable/detachable, comprising:

means for notifying an abnormality in a case where contacts between the at least two connection terminals in the head side and at least two corresponding terminals in the apparatus side are not detected.

In a third aspect of the present invention, there is provided an ink jet printing head attachable/detachable to/from an ink jet printing apparatus, comprising:

an ejecting portion having ink ejection openings and elements for generating energy to eject ink from the ink ejection openings; and a plurality of connection terminals for carrying out an electrical connection of signals including drive signals of the elements by contacting a plurality of connection terminals in the ink jet printing apparatus when the head is mounted on a main body of the ink jet printing apparatus, wherein the plurality of connection terminals are arranged in a planar area, which is substantially rectangular-shaped, and wherein at least two terminals positioned in corners of the planar area are used as terminals for detection to carry out a confirmation of contacts of all of the plurality of connection terminals, the at least two of the terminals for detection are used for at least two signals of different types.

In the present invention, in arrangement areas of connection terminals in the printing head side and corresponding connection terminals in the side of the main body of the printing apparatus, at least two pairs of connection terminals positioned in a region where distances between terminals can be maximum due to a deviation in mounting are used as terminals for contact detection. For example, from among a group of connection terminals arranged in a planar area, which is almost rectangular-shaped, connection terminals positioned in two corners of the area are used as the terminals for contact detection. By detecting contacts of these terminals by this approach, connection of all the connection terminals in an inner side of the area can be guaranteed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will be described in detail below by referring to figures.

1. Configuration Example of Ink Jet Printing Apparatus

Figure 1:
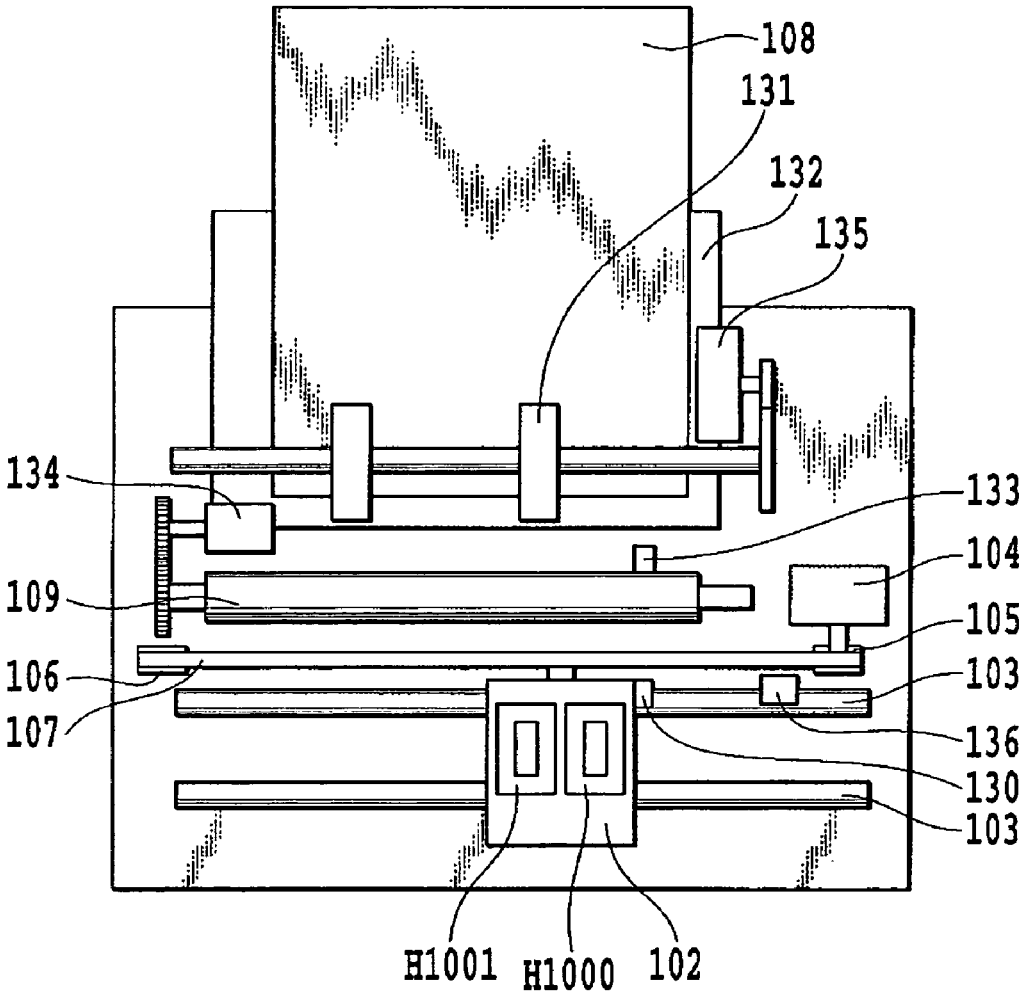
FIG. 1 is a plan view schematically showing one example of an ink jet printing apparatus where the present invention is applicable.

FIG. 1 is a plan view schematically showing one example of an ink jet printing apparatus where the present invention is applicable. This printing apparatus has a carriage 102 for detachably mounting printing heads H1000 and H1001. The carriage 102 is provided with electrical connection portion for transmitting drive signals and the like to ejecting portions via external signal connection terminals on the printing heads H1000 and H1001 in the carriage 102.

The carriage 102 is supported so as to reciprocally move along a guide shaft 103 installed in a main body of the apparatus and extended in a main scan direction. The carriage 102 is driven and its position and movement are also controlled by a main scanning motor (carriage motor) 104 via drive transmission mechanisms such as a motor pulley 105, an idler pulley 106, and a timing belt 107. Moreover, a home position sensor 130 is provided on the carriage 102. A position as a home position will be detected when the home position sensor 130 on the carriage 102 passes a position of a shield plate 136.

A print medium 108 made of paper, plastic thin plate and the like is fed one by one from an auto sheet feeder (ASF) 132 by a paper feeding motor 135 rotating a pick up roller 131 via a gear. Furthermore, the print medium 108 is conveyed (sub-scanned) passing a position (print area) opposing a surface (ejection face) where ejection openings of the printing heads H1000 and H1001 are formed, by a rotation of a conveying roller 109 driven by a conveying motor 134 via a gear. Determination of whether the print medium 108 is fed or not and identification of a position of the print medium front end during paper feeding are carried out at the time point when the print medium 108 passed a paper end sensor 133. This paper end sensor is also used for identifying an actual position of a rear end of the print medium 108 to eventually determine a current printing position based on the actual position of the rear end.

It should be noted that the print medium 108 is supported on its back surface by a platen (not illustrated) so as to form a flat surface to be printed in the print area. In this case, the printing heads H1000 and H1001 mounted on the carriage 102 are held so that their ejection faces protrude downward from the carriage 102 and become parallel to the print medium 108, and are main-scanned on the print area.

The printing heads H1000 and H1001 are mounted on the carriage 102 so that an arrangement direction of the ejection openings in each ejecting portion coincides with a direction (for example, sub-scan direction) intersecting the main scan direction of the carriage 102. By ejecting ink from columns of these ejection openings during the main scanning, printing in a width corresponding to a range of ejection opening arrangement is performed.

2. Configuration Example of Ink Jet Printing Head

A first printing head H1000 and a second printing head H1001 are used in the present embodiment. Each printing head is formed by inseparably integrating ink tank(s). The first printing head H1000 has an ink containing portion filled with black ink and the ejecting portion for ejecting black ink supplied from this ink containing portion. The second printing head H1001 has ink containing portions filled with color inks (cyan ink, magenta ink, yellow ink) and ejecting portions for ejecting the respective color inks supplied from the respective ink containing portions. Each of the printing heads H1000 and H1001 is fixedly supported on the carriage 102 by positioning means and an electrical contact point and in a form of a cartridge attachable/detachable to/from the carriage. The printing head can be replaced when the filled ink is used up.

Out of the printing heads H1000 and H1001 used in the embodiment, a configuration of the printing head H1001 for color inks will be described below. As for the printing head H1000, its description will be omitted since it can adopt a similar configuration to that of the printing head 1001 apart from the fact that the configuration is only for one color, i.e. black ink.

Figure 2A:
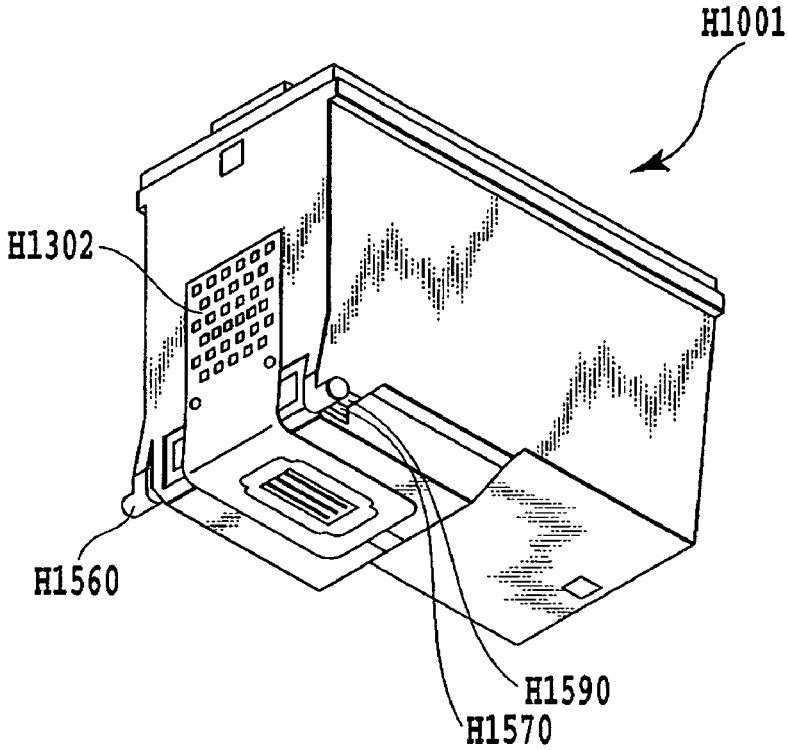
FIGS. 2A and 2B are perspective views showing a configuration example of one of a printing head, which can be mounted on the printing apparatus in FIG. 1.
Figure 2B:
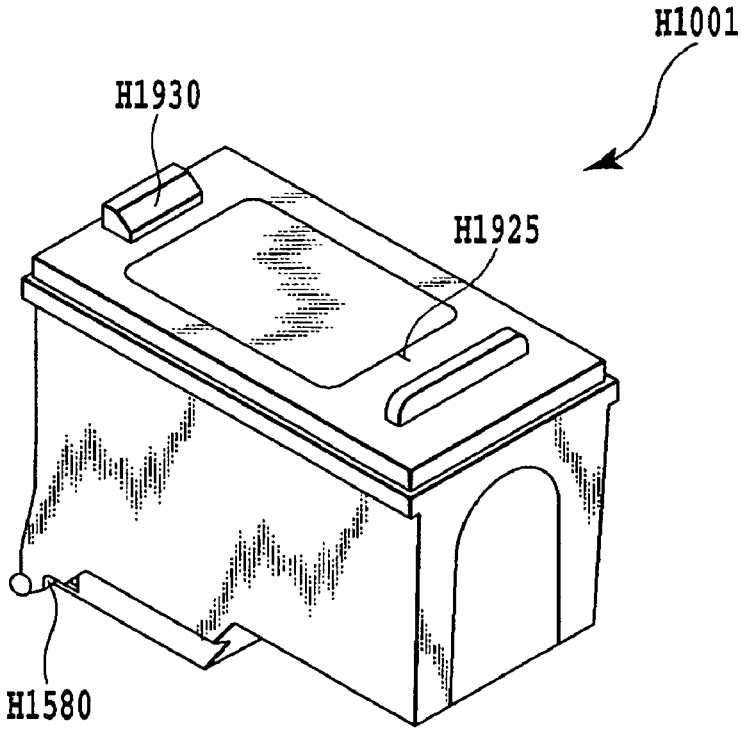
Figure 3A:
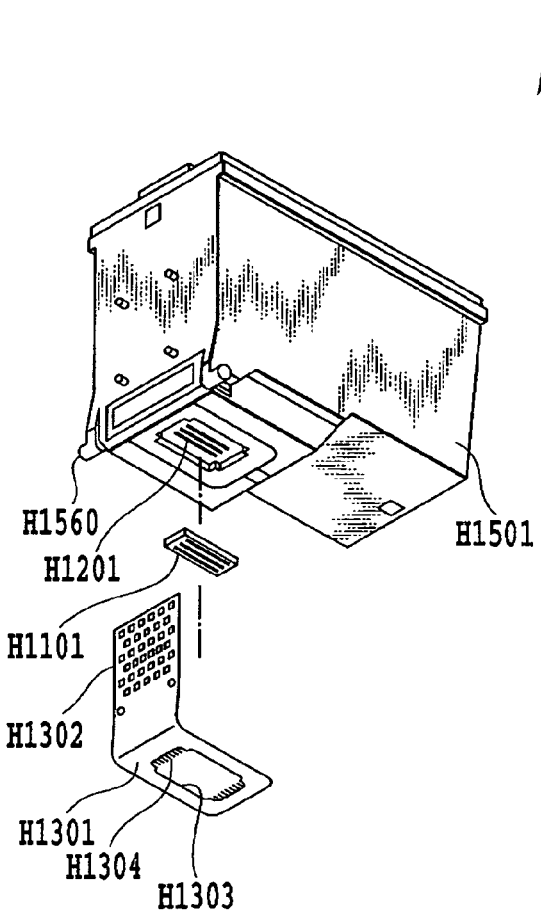
FIGS. 3A and 3B are exploded perspective views of the printing head shown in FIGS. 2A and 2B.
Figure 3B:
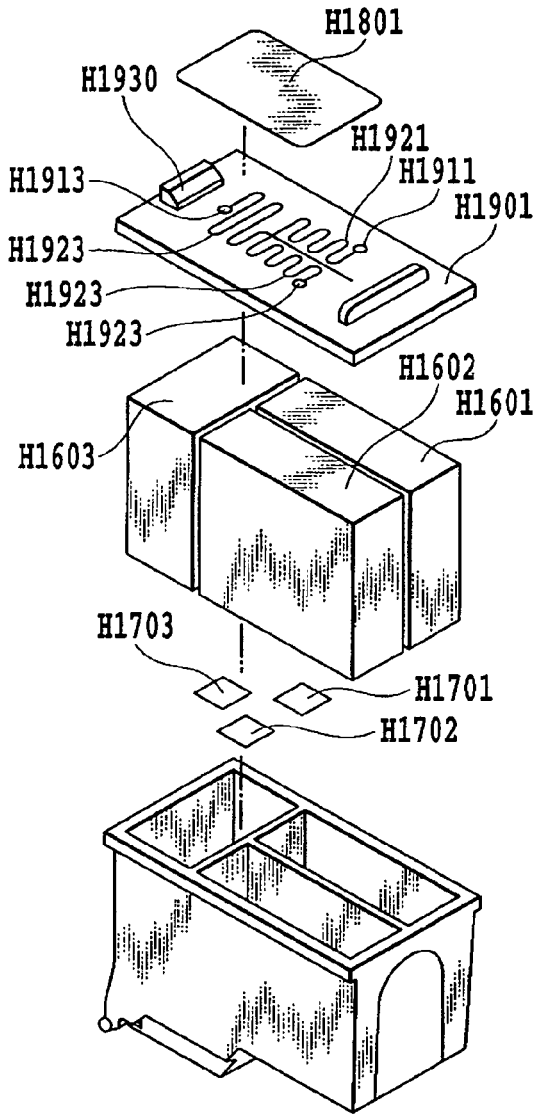

FIGS. 2A and 2B are perspective views showing a configuration example of the printing head 1001, which can be mounted on the printing apparatus in FIG. 1, and FIGS. 3A and 3B are exploded perspective views thereof.

The printing head H1001 is for ejecting three colors of ink, i.e. cyan, magenta, and yellow, and configured as shown in the exploded perspective views in FIGS. 3A and 3B. In other words, the head has a print element substrate H1101, an electric wiring tape H1301, an ink containing and supplying member H1501, filters H1701, H1702, and H1703, ink absorbers H1601, H1602, and H1603, a cover member H1901, and a seal member 1801.

Figure 4:
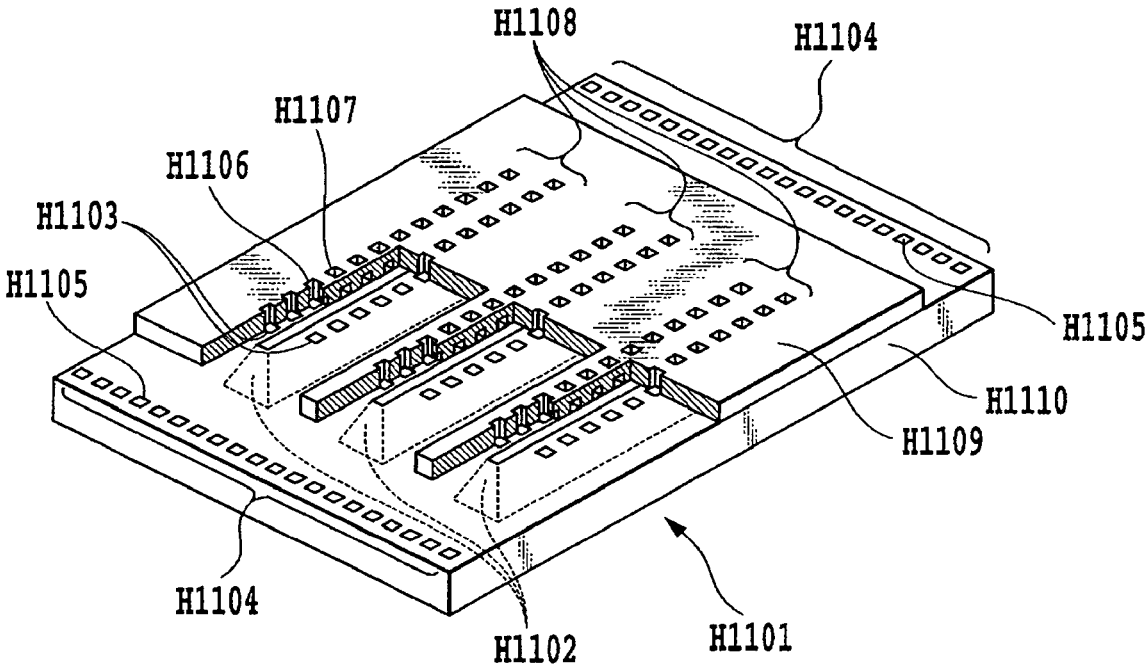
FIG. 4 is a perspective view showing a configuration example of a print element unit provided in the printing head shown in FIGS. 2A and 2B.

FIG. 4 is a partially cutaway perspective view for explaining a configuration of the print element substrate H1101. This print element substrate H1101 is configured by forming three long hole-shaped ink supply ports H1102 for each color ink of cyan, magenta, and yellow in parallel on an Si substrate H1110 with a thickness of 0.5 mm to 1 mm. The ink supply ports H1102 are formed by methods such as anisotropic etching utilizing crystal orientation of Si and sandblasting. An array of electrothermal transducer elements H1103 for generating thermal energy to cause film boiling in ink in response to electrical signals is arranged at each side of the ink supply port H1102. Two arrays of the eletrothermal transducer elements are placed in a staggered manner by shifting a half arrangement pitch in the arrangement direction, that is, the sub-scan direction. Ejecting portions H1108 for each color are configured on this print element substrate H1101 by joining an ejection opening forming member on which ink passage walls H1106 and ejection openings H1107 are formed by applying a photolithography technique to resin materials, while aligning each electrothermal transducer element with each ejection opening. The printing head with such a configuration ejects ink in a vertical direction to a surface of the print element substrate.

Electric wirings, logic circuits, a temperature sensor, an electrode portion H1104 and the like are formed on the Si substrate H1110. The electric wirings are for supplying power to the electrothermal transducer elements H1103 and are formed from Al and the like. The logic circuits are for driving the electrothermal transducer elements in response to printing data. The temperature sensor carries out temperature detection for performing a temperature adjustment of the printing head and is constituted of diodes and the like. These portions are electrically connected with the outside by the electrode portion H1104. Furthermore, a bump H1105 made of Au and the like is formed on each of electrodes in the electrode portion H1104. Note that the electrothermal transducer elements H1103 and the like can be formed using existing film-forming techniques.

In FIGS. 3A and 3B, reference numeral H1301 denotes an electric wiring tape made by forming a wiring pattern made of copper foils on a base substrate formed of polyimides. The electric wiring tape has electrical signal paths, which apply electrical signals to the print element substrate H1101 for ejecting ink. An opening for incorporating the print element substrate H1101 is formed in the electric wiring tape H1301, and electrode terminals H1304, which are connected to the electrode portion H1104 of the print element substrate H1101, are formed in a vicinity of a rim of this opening. Moreover, external signal connection terminals (contact pads) H1302 for receiving electrical signals from the main body of the apparatus are formed in the electric wiring tape H1301 and the electrode terminals H1304 and the external signal connection terminals H1302 are connected by continuous wiring patterns made of copper foils.

An electrical connection between the electric wiring tape H1301 and the print element substrate H1101 can be carried out as follows, for example. It is carried out by electrically connecting the bump H1105 formed in the electrode portion H1104 on the print element substrate H1101 and the electrode terminal H1304 in the electric wiring tape H1301 corresponding to the electrode portion H1104 on the print element substrate H1101 with thermal ultrasonic compression bonding.

Reference numeral H1501 denotes an ink containing and supplying member formed, for example, by resin molding. It is desirable to use resin materials mixed with 5 to 40% of glass filler in order to improve rigidity in shape. The ink containing and supplying member H1501 has an ink tank function and an ink supply function. In other words, as shown in FIGS. 3A and 3B, the ink tank function is realized by having a space for housing each of the ink absorbers H1601, H1602, and H1603 independently, which are for generating negative pressure in order to retain the inks of cyan, magenta, and yellow inside. Moreover, the ink supply function is realized by forming independent ink passages for introducing ink respectively to each of the ink supply ports H1102 on the print element substrate H1100. Although compressed polypropylene (PP) fibers are used for the ink absorbers H1601, H1602, and H1603, compressed urethane fibers can be used instead. Each of the filters H1701, H1702, and H1703 is joined by welding in a boundary portion between each ink passage and each of the ink absorbers H1601, H1602, and H1603 positioned upstream thereof. These are arranged in order to prevent foreign particles from entering inside the print element substrate H1101. Although each of the filters H1701, H1702, and H1703 can be a mesh type formed of metal such as SUS, sintered metal (such as SUS) fiber type is more favorable.

An ink supply port H1201 for supplying each cyan, magenta, and yellow ink to the print element substrate H1101 is formed in downstream of the ink passage. The print element substrate H1101 is adhered and fixed to the ink containing and supplying member H1501 with high accuracy of position so that each of the ink supply ports H1102 on the print element substrate H1101 communicates with each of the ink supply ports H1201 of the ink containing and supplying member H1501. A first adhesive agent used for this adhesion desirably has a low viscosity and low curing temperature, cures in short time, and has a relatively high hardness and also an ink resistance after being cured. A thermosetting adhesive agent having an epoxy resin as its major component can be one example of such a first adhesive agent. When using this thermosetting adhesive agent, a thickness of its adhesive layer is desirably approximately 50 μm.

Moreover, a back surface of a part of the electric wiring tape H1301 is adhered and fixed to a plane in a periphery near the ink supply ports H1201 by a second adhesive agent. A part electrically connecting a second print element substrate H1101 and the electric wiring tape H1301 is sealed by first and second sealants, so that the electrically connected part is protected from corrosion by ink or external impacts. The first sealant mainly seals a reverse side of a connecting portion between the electrode terminal H1304 in the electric wiring tape 1301 and the bump H1105 on the print element substrate, and a circumferential part of the print element substrate, while the second sealant seals a obverse side of the connecting portion. Unadhered part of the electric wiring tape H1301 is bent and fixed to a side surface of the ink containing and supplying member H1501, the side surface being almost perpendicular to a surface having ink supply ports H1201, by heat staking or adhesion and the like.

Reference numeral H1901 denotes a cover member which blocks independent spaces inside the ink containing and supplying member H1501 by being welded in an upper opening of the ink containing and supplying member H1501. Note that the cover member H1901 has thin ports H1911, H1912, and H1913 for releasing pressure fluctuation in each room inside the ink containing and supplying member H1501 and has fine grooves H1921, H1922, and H1923, respectively, communicating with these thin ports. The other ends of the fine grooves H1921 and H1922 join the midpoint of the thin groove H1923. Furthermore, an air communication port H1925 is formed by covering most of the fine groove H1923 and all of the thin ports H1911, H1912, and H1913 and the fine grooves H1921 and H1922 with a seal member H1801, and opening the other end part of the fine groove H1923. Moreover, the cover member H1901 has an engaging portion H1930 for fixing the second printing head to the ink jet printing apparatus.

The printing head H1001 is provided with a mounting guide H1560, the engaging portion H1930, and abutting portions H1570, H1580, and H1590. The mounting guide H1560 is for guiding to a mounting position of the carriage 102 in the main body of the ink jet printing apparatus. The engaging portion H1930 is for mounting and fixing the printing head H1001 onto the carriage by engaging with a fixed lever (not illustrated) provided in a carriage side. The abutting portions H1570, H1580, and H1590 are for positioning the printing head H1001 in a predetermined mounting position of the carriage. The abutting portions H1570, H1580, and H1590 carry out positioning in an X-direction (main scan direction), a Y-direction (sub-scan direction), and a Z-direction (ink ejecting direction), respectively. An electrical contact between the external signal connection terminal H1302 in the electric wiring tape H1301 and a contact pin of an electrical connection portion provided in the carriage becomes possible by being positioned in the carriage 102 by these abutting portions.

Note that mounting of a printing head containing a light magenta ink, a ink light cyan and a black ink, instead of the printing head H1000, which is exclusive for the black ink, with a similar configuration to that of the printing head H1001 as described so far is also possible. In other words, the printing apparatus can be used as a photo printer of high image quality by this.

Moreover, the printing head, which is formed by inseparably integrating ink tanks, is shown as an example in the present embodiment. However, as long as the configuration is the one where attaching/detaching to/from a support member like the carriage is possible, the printing head formed by integrating separable ink tanks can also be adopted and moreover, the printing head formed separately from the ink tanks can also be adopted.

3. Characteristic Configuration

It is highly desirable that a datum for the positioning be provided in a vicinity of the ejecting portion. This is because the ejecting portion carries out printing by ejecting ink while being close to and opposing a printing medium. On the other hand, a contact pad is provided in a position where a connection to a connection terminal (for example, a contact pin) in the carriage side is easily made and from a viewpoint of reducing a possibility of a short circuit among electrodes due to a possible ink leakage, it is provided desirably in a position distant from the ejecting portion. Then, when the printing head is mounted, even if it comes to a state where the positioning to the carriage in the vicinity of the ejecting portion is secured by the positioning datum, there is a possibility that an electrical connection state is being unstable in a position where the connection terminals should be contacted with each other due to an influence of mounting deviation.

For example, as in the present embodiment, there is a case where a terminal surface in a printing apparatus side (carriage 102 side) and a contact pad surface in a printing head side are not parallel in the configuration where a group of contact pads H1302 are provided in a plane part of the electric wiring tape H1301, in case of occurrence of the mounting deviation. In that case, a distance between the terminal surface in the printing apparatus side and the contact pad surface in the printing head side is different between end portions opposing to each other in a terminal arrangement area. Then, contact failures occur when the distance exceeds a tolerance of a stroke of a contact mechanism. Thus, contacts of other contact pads are not guaranteed even when the contacts of a part of contact pads selected simply at random are detected.

Accordingly, in the present invention, a configuration is provided where terminals served for detection are appropriately selected and the contacts of all terminals are guaranteed by detecting only the contacts of parts of terminals. In other words, the present invention uses the connection terminals for contact detection which are positioned in a portion where a difference in distances between terminals can be maximum due to the mounting deviation, on arrangement areas of the external signal connection terminals in the printing head side and corresponding connection terminals in the main body side. In the present embodiment, a group of contact pads are arranged two dimensionally in a planar area, which is almost rectangular-shaped. Therefore, the difference in distances between terminals due to the mounting deviation can be maximum in rim portions opposite to the area, in particular, rim portions most distant from and closest to the positioning datum. In other words, the distance between terminals can be maximum in any corner of the area provided with the external signal connection terminals H1302. Accordingly, when the contacts are detected in the corners, connections of all the contact pads inside the area can be guaranteed. Connection terminals positioned in three corners are used for the contact detection in the present embodiment.

Figure 5:
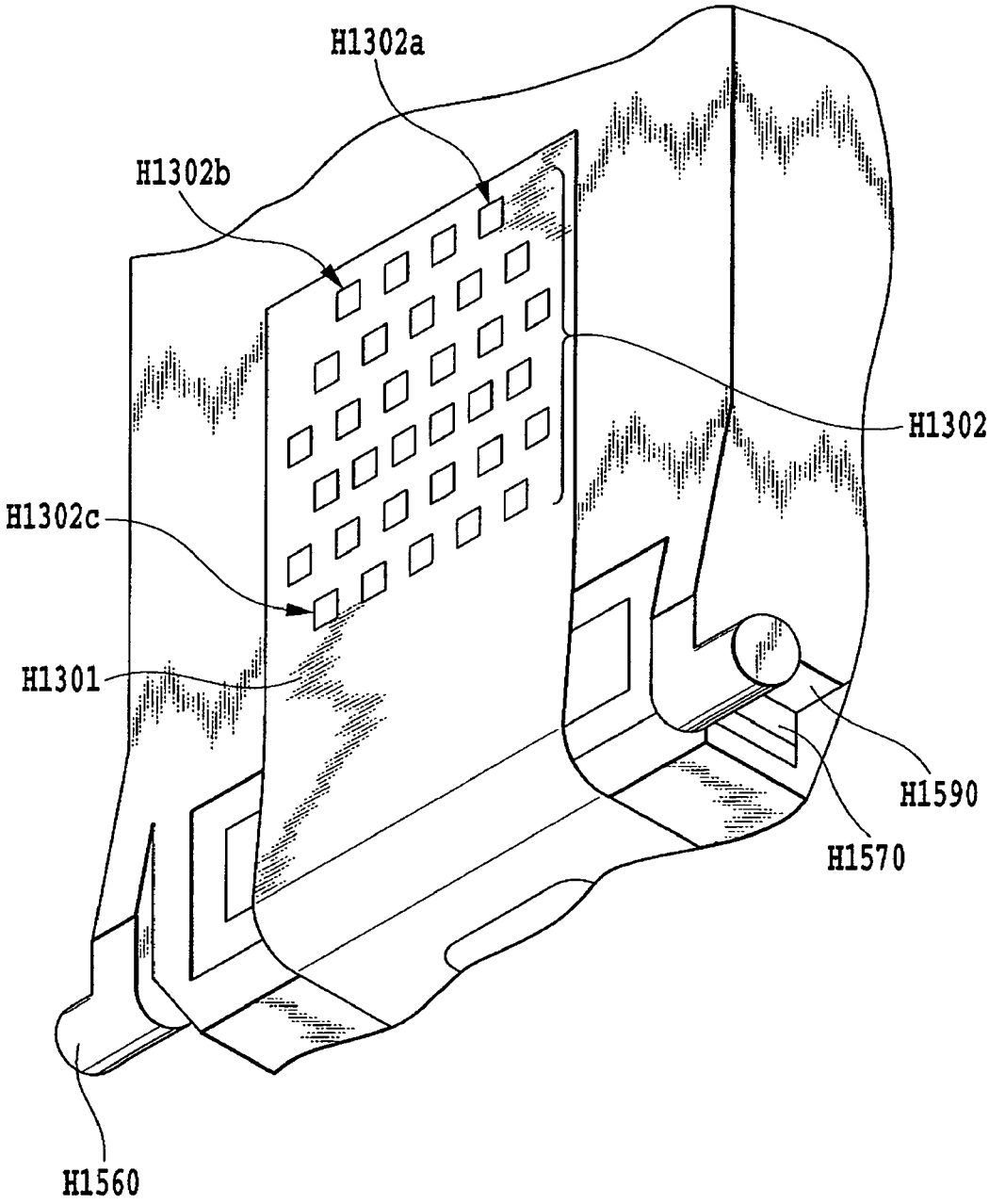
FIG. 5 is an enlarged perspective view showing an external signal connection portion of an electric wiring tape in the printing head shown in FIGS. 2A and 2B.

FIG. 5 is an enlarged perspective view showing an external signal connection portion of the electric wiring tape H1301 in the printing head of the present embodiment. 32 external signal connection terminals (contact pads) H1302, which are rectangle-shaped, are arranged two dimensionally in the electric wiring tape H1301. Three of these contact pads H1302 positioned in the corners of the arrangement area are used for the contact detection. In other words, contact pads H1302*a*, H1302*b*, and H1302*c*, which are positioned in a top right corner, top left corner, and bottom left corner in the figure, respectively, are used for the contact detection. Hereinafter, these pads are also referred to as contact check pads. When a connection state is confirmed by inputting power or signals from the main body of the printing apparatus to three contact check pads provided in the corners as described above, it is possible to regard that the contacts of other contact pads are also made.

Moreover, in the present embodiment, not only positions of the contact check pads but also signals used for the contact detection are also appropriately selected. Furthermore, at this point, the contact detection is carried out by using not only a same type of signals but also different types of signals. Note here that at least one type of signals is related to drive control of nozzles, in other words, logic signals, which carry out the drive control of nozzles are used, and at least one of other types of signals is unrelated to this.

Specifically, the logic signals include drive control signals (DATA) of the electrothermal transducer elements in accordance with the printing data, a signal (HE) determining a drive waveform, and clock signals (CLK) regulating a transfer of various signals or an operation on the print element substrate. In the present embodiment, a signal determining the drive waveform is used for the contact detection and the contact check pad H1302*a* carries out a connection of this signal. Moreover, a signal of temperature detection means (temperature sensor) for performing the temperature adjustment of the printing heads or ink, is used as a signal unrelated to the signal determining the drive waveform. This temperature sensor can be implemented during a manufacturing step of the print element substrate in a print element unit in a form of a semiconductor diode. The contact pad H1302*b* is for carrying out connection of this signal.

It is preferable to use different types of signals as described above especially in a case where the printing head is used which is made by forming the electrothermal transducer elements and drive logic circuits on the same print element substrate in a process similar to a semiconductor manufacturing process. This is because reliability of the detection is not guaranteed even when the contact detection is carried out based only on a plurality of signals participating in a logic system, since an entire logic circuit can malfunction due to the contact failure.

Furthermore, since, for an operation of the logic circuit and so forth on the print element substrate, a power supply VDD of TTL level (normally 5V) is required other than a power supply VH for the electrothermal transducer elements, this is supplied via the contact pad H1302*c*.

Figure 6:
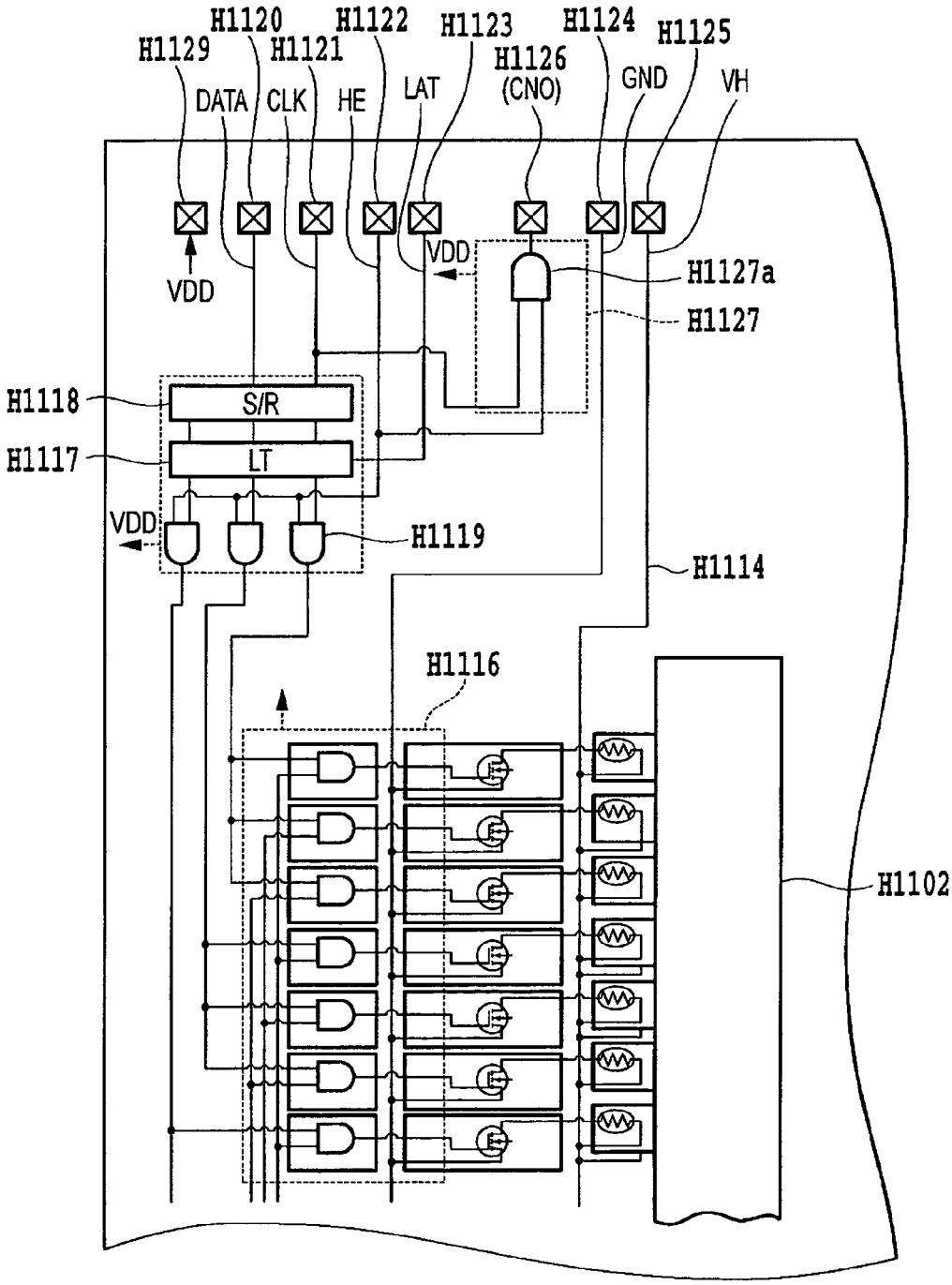
FIG. 6 is a circuit diagram showing an electrical configuration on a print element substrate provided in the print element unit in FIG. 4.

FIG. 6 is a circuit diagram showing an electrical configuration on the print element substrate provided in the print element unit. Note here that denoted H1120 is an electrode for print data signals (drive control signals of the electrothermal transducer elements) DATA transferred serially. Reference numeral H1121 denotes an electrode for the clock signals CLK. Reference numeral H1122 denotes an electrode for a signal (a heat enable signal) HE, which determines the drive waveform of the electrothermal transducer elements. Reference numeral H1123 denotes an electrode for a latch signal LAT in order to latch the drive control signals DATA of the electrothermal transducer elements aligned in a shift register, which is described later. Reference numeral H1125 denotes an electrode pad for the power supply (VH) supplied to the electrothermal transducer elements, and reference numeral H1124 denotes an electrode for ground (GND) corresponding to this. Reference numeral H1126 denotes an electrode for signal output used in order to carry out the contact detection using the heat enable signal HE and reference numeral H1129 denotes an electrode for a logic power supply (VDD). Moreover, although not shown in this figure, an electrode for a signal DIA connected to the temperature sensor and an electrode for ground (VSS) for the logic circuit and the temperature sensor are provided.

These electrodes are connected to the contact pads H1302 in FIG. 5 via the electrical signal paths formed in the electric wiring tape H1301. The electrode H1122 for the heat enable signal HE in particular is connected to the contact pad H1302*a* positioned in the top right corner of the pad arrangement area in FIGS. 3A and 3B. The electrode H1129 for the logic power supply (VDD) is connected to the contact pad H1302*c* positioned in the bottom left corner. The electrode for the signal DIA connected to the temperature sensor is connected to the contact pad H1302*b* positioned in the top left corner.

In the printing head H1101 of the present embodiment, n nozzles are provided per one row by the ink supply port H1102 in each of the ejecting portions. The electrothermal transducer element H1103 for heating ink in the nozzle and a drive element H1116 for driving the electrothermal transducer element H1103 are provided by corresponding to the respective one of the nozzles. Hereinafter, a combination of each electrothermal transducer element, drive element, and nozzle is also referred to as a print element. A time division driving method, which divides n print elements into a plurality of blocks and drives sequentially, is adopted in the configuration in FIG. 6.

A brief description of the driving method of the printing head of such configuration follows.

The printing data DATA of a predetermined number (the number of nozzles driven simultaneously included in one unit of time division) of bits are serially inputted via the electrode H1120 synchronously with the clock signals CLK inputted via the electrode H1121 and are aligned and retained in the shift register (S/R) H1118. When the printing data are retained in the shift register H1118 as described above, a latch circuit H1117, which is located in a next stage of the shift register H1118, latches the printing data in response to the latch signal LAT inputted via the electrode H1123. A logical product between each of the drive control signals of the electrothermal transducer elements outputted from the latch circuit H1117 and the heat enable signal HE inputted to the electrode H1122 is calculated by an AND circuit H1119.

On the other hand, block selection signals (BLE) for dividing and driving n electrothermal transducer elements H1103 is added as a part of the printing data in a serial data form. This is inputted to a decoder not shown and the block selection signals BLK are generated for selecting each of blocks (one unit of time division driving), which includes electrothermal transducer elements to be driven simultaneously, on the print element substrate. The print elements selected by an output from the AND circuit H1119 from among the print elements selected by these block selection signals are driven and power is applied to the electrothermal transducer elements in response to this, leading to ink ejection from the nozzles and carrying out of printing operation. During this drive, the print signals, clock signals, latch signal and the like for carrying out the printing in a next unit of time division driving are inputted to the printing head.

Figure 7:
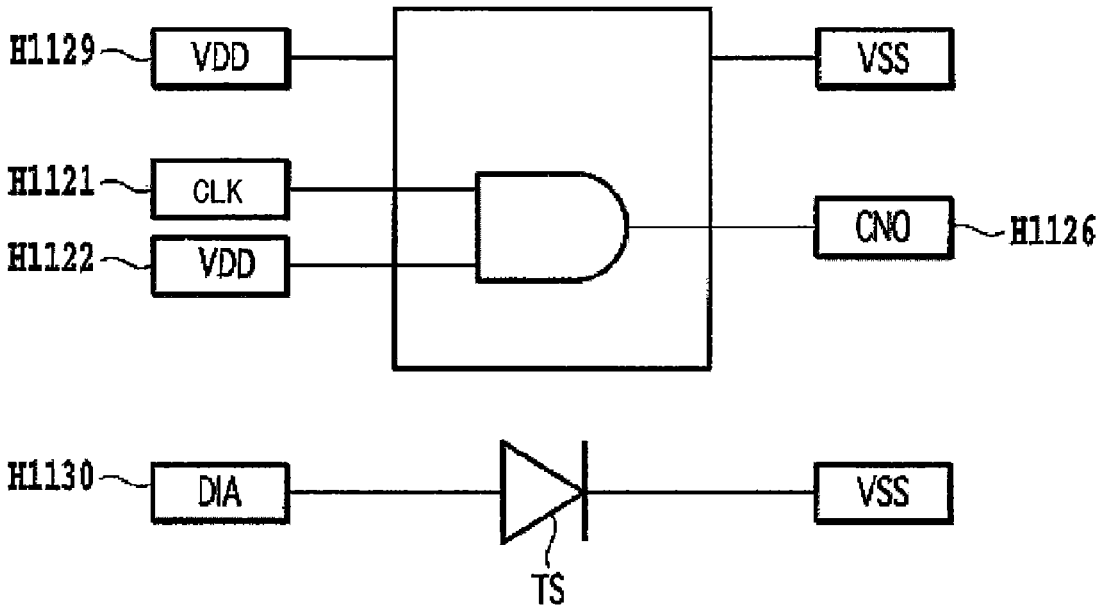
FIG. 7 is a circuit diagram particularly showing a major portion for contact detection of the external signal connection portion in FIG. 6.

A configuration carrying out the contact detection, which is a characteristic item of the present embodiment, will be described next. FIG. 7 is a circuit diagram particularly showing an extracted major portion applied for the contact detection of the external signal connection portion in FIG. 6.

The heat enable signal HE is adopted as one of the signals used for the contact detection in the present embodiment. It is also possible to carry out the detection by a configuration where the heat enable signals HE are simply returned to the main body side. However, in the present embodiment, an operation result CNO of a connection state confirmation circuit H1127 constituted of an AND circuit H1127*a* operating a logical product between the signal heat enable signal HE and the clock signals CLK is outputted to the main body of the printing apparatus via a connection state output terminal H1126. The power supply VDD supplying power to the logic system formed of transistors relevant to the drive control of the print element also drives such a connection state confirmation circuit H1127.

By using two logic signals as in the present example, even when a malfunction occurred in one signal path, for example, resulting in a state where normal signals are always outputted upon input of power supply, the electrical connection state can be correctly confirmed by signals from other signal path. Note that although the contact pad of the clock signals CLK can be positioned anywhere, it can be positioned in a remaining corner (bottom right of the area) in an arrangement in FIGS. 3A and 3B, for example.

Moreover, the input signal DIA connected by the electrode H1130 to a temperature sensor TS formed of semiconductor diodes, the signal DIA being unrelated to the print element drive control, is used as a different type of signal for confirming the electrical connection state and is supplied to the main body of the printing apparatus to measure current value thereof for the contact detection.

By carrying out the contact detection using plural types of signals as described so far, even in a case where a malfunction occurred in one signal path and incorrect contact detection is carried out (a case where detecting that a contact is made even though there is no contact), the electrical connection state can be correctly confirmed by the other signal path.

A configuration and processing in the printing apparatus side for carrying out the contact detection or the confirmation of the electrical connection state will be illustrated next.

Figure 8:
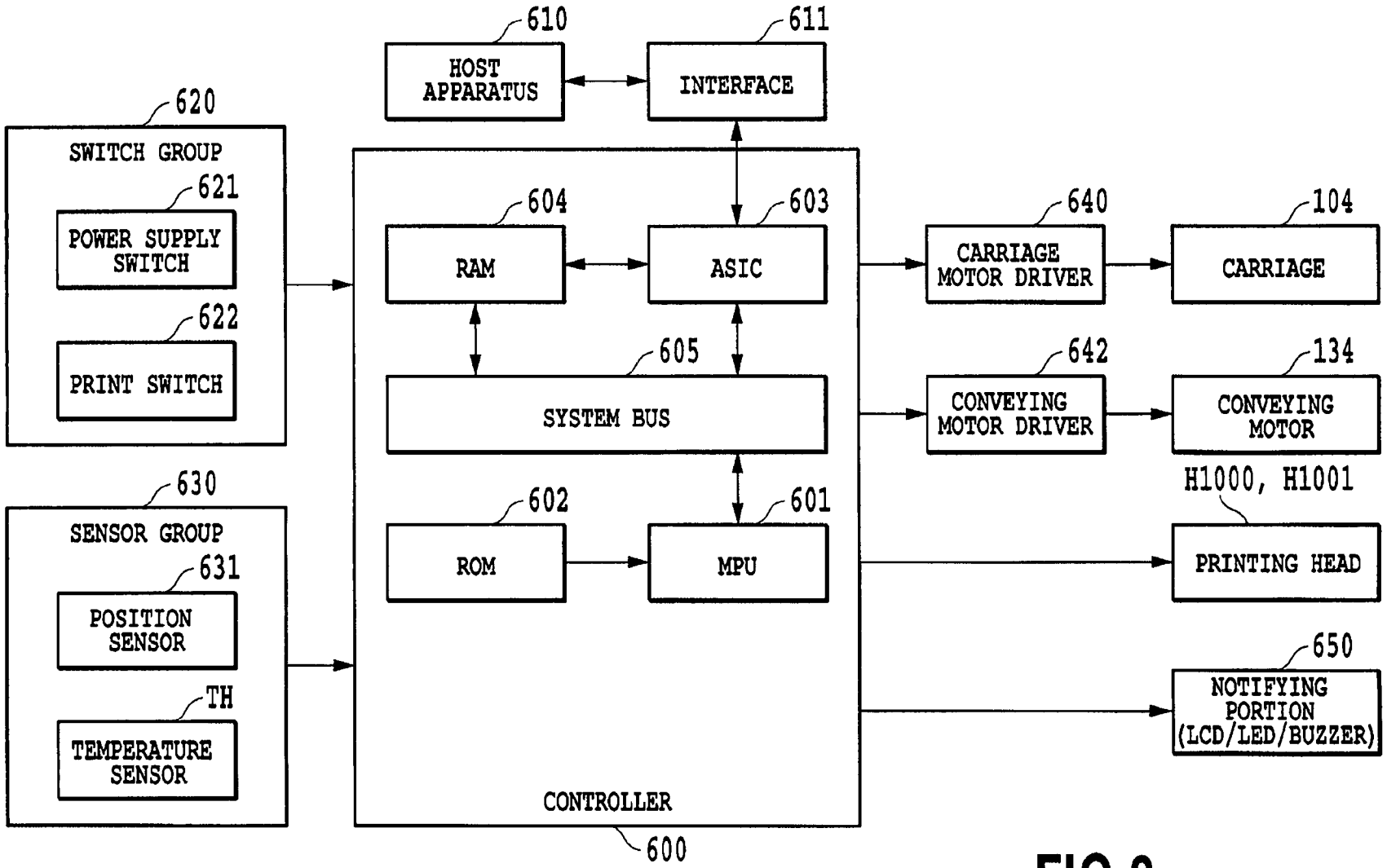
FIG. 8 is a block diagram showing a configuration example of a control system of the printing apparatus in FIG. 1.

FIG. 8 is a block diagram showing a configuration example of a control system of the printing apparatus shown in FIG. 1.

As shown in FIG. 8, a controller 600 forming a main control portion of the apparatus has an MPU 601, and a ROM 602 storing a program corresponding to a control procedure described later, required tables and other fixed data. Moreover, the controller 600 has an application specific integrated circuit (ASIC) 603 for generating control signals to control the carriage motor 104, the conveying motor 134, and the printing heads H1000 and H1001. Furthermore, the controller 600 has a RAM 604 provided with an area for spreading image data and an area for work during the execution of the program. Further, the controller 600 has a system bus 605 for carrying out transmitting and receiving of data by connecting the MPU 601, ASIC 603, and RAM 604.

Moreover, reference numeral 610 denotes a host apparatus as a source of supply of image data to the printing apparatus such as computers, readers for reading images, or digital cameras. Image data, commands, status signals and the like are sent and received between the host apparatus 610 and the printing apparatus via an interface (I/F) 611.

Reference numeral 620 denotes a group of switches constituted of switches for receiving instruction input by an operator such as a power supply switch 621 and a print switch 622 and the like for instructing to start printing. Reference numeral 630 denotes a group of sensors for detecting an apparatus state and constituted of a position sensor 631 such as a photo-coupler for detecting the home position, and the temperature sensor (diode sensor) TH provided on the print element substrate and the like.

Furthermore, reference numeral 640 denotes a carriage motor driver driving the carriage motor 104 for making the carriage 2 scan back and forth in the main scan direction, and reference numeral 642 denotes a conveying motor driver driving the conveying motor 134 for conveying the printing medium.

Figure 9:
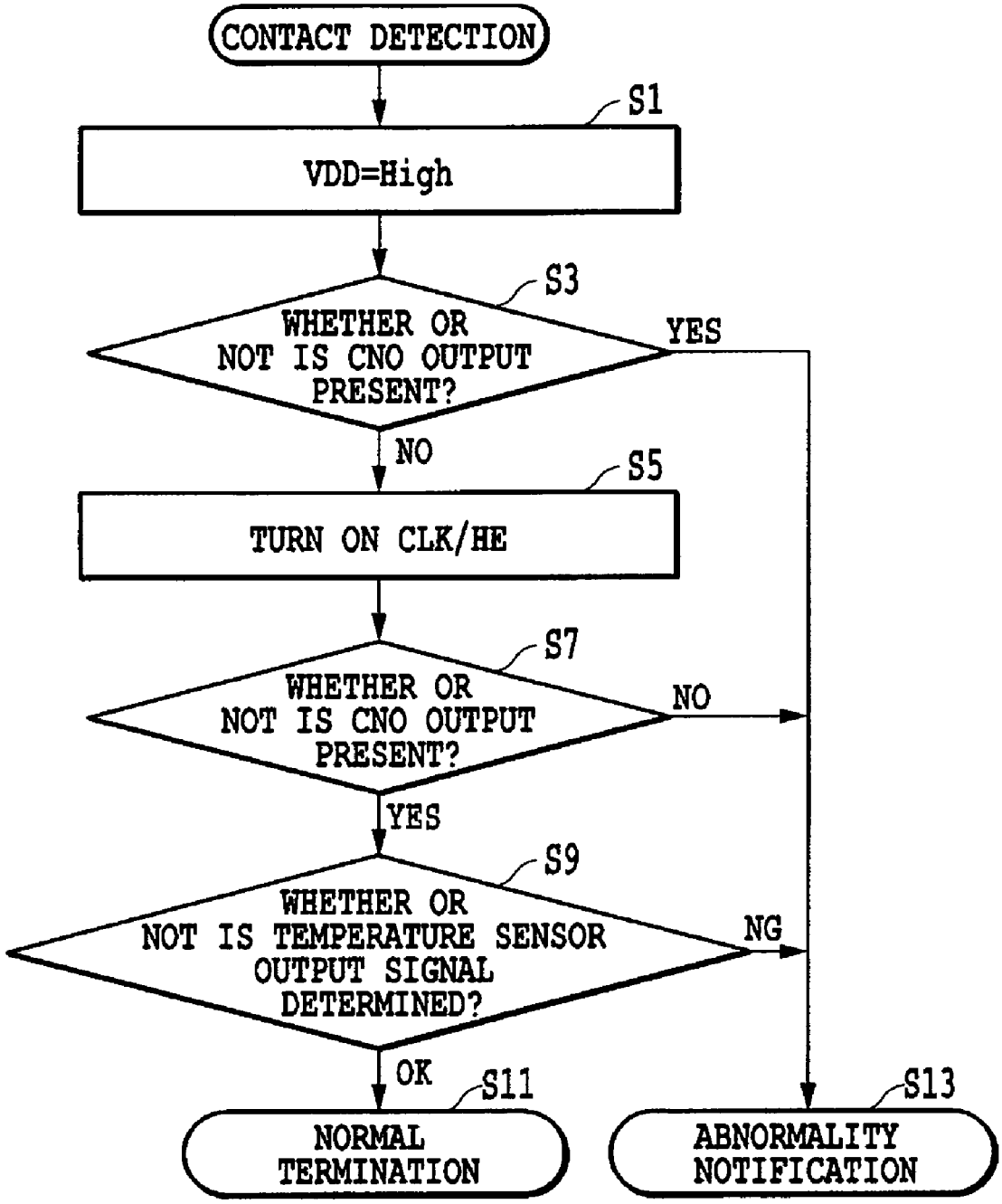
FIG. 9 is a flowchart showing one example of a contact detection procedure of the external signal connection portion.

FIG. 9 is a flowchart showing one example of a contact detection procedure of the external signal connection portion. Firstly, the logic power supply VDD is supplied in step S1 and the operation result CNO of the connection state confirmation circuit H1127 is determined in step S3. Since the heat enable signal HE is not supplied at this stage, if any waveform appear while an output CNO should be essentially "0", it is determined that some form of malfunction has occurred as a result of the mounting deviation and an abnormality notification is carried out (step S13).

On the other hand, when the output CNO is confirmed as "0", the clock signals CLK and the heat enable signal HE are supplied in step S5, and the operation result CNO of the connection state confirmation circuit H1127 is determined. When both signals are normally supplied, as a result of an AND operation, the same waveform to that of the clock signals CLK appears in an ON period of the heat enable signal HE in the output CNO. However, if this does not appear, it is determined that some form of malfunction has occurred as a result of the mounting deviation and the abnormality notification is carried out (step S13).

When the output CNO is confirmed as non-"0" in step S7, the procedure proceeds to step S9 and the current value of the signal DIA related to the temperature sensor TH is determined. When the temperature information is detected here, the procedure terminates normally (step S11) and if not (a case where the current value is not detected since the contact pad H1302*b* is not contacting the terminals in the corresponding carriage side), abnormality notification is carried out (step S13).

Incidentally, abnormality notification can be carried out via a notifying portion 650 (FIG. 8) provided in the printing apparatus. Display means such as an LCD and an LED provided on an operation panel and the like in the printing apparatus or sound output means like a buzzer can be adopted as the notifying portion 650. Moreover, by communicating with the host apparatus 610, the notification may be carried out via the display means or sound output means in the host apparatus side. Furthermore, these can be used in combination where appropriate.

In addition, either of the detection using logic signals or the detection using temperature sensor signals can be carried out first.

4. Others

In the above described embodiment, a group of contact pads are arranged two dimensionally in the planar area, which is almost rectangular-shaped. Accordingly, since the distance between terminals in the printing head side and in the printing apparatus side becomes maximum at certain corners of the arrangement area due to the mounting deviation, connection terminals present in the corners are selected as the contact check pads. However, the contact check pads can be selected appropriately in accordance with a shape of the arrangement area of the contact pads and the like. That is, terminals whose distances from the connection terminals in the printing apparatus side become maximum due to the mounting deviation should be selected.

Moreover, although the heat enable signal and the clock signals are used as the logic signals used for the contact detection in the above embodiment, other signals may be used. For example, a part of bits constituting a format of the serial print data signals may be used. Similarly, if there are those other than signals related to the temperature sensor as described above, they may be used if they are signals unrelated to the logic signals.

Furthermore, it is certainly possible to determine the number of color tones and types such as color and density of ink used where appropriate and it is needless to say that the present invention is not limited to those described in the aforementioned embodiment.

Additionally, since the print element and the drive logic circuit can be integrated on the same print element substrate by a similar process to the semiconductor manufacturing process, the present invention can be favorably applied especially to the ink jet printing head using the electrothermal transducer elements. This is because the number of terminals for carrying out the electrical connection increases in such a printing head since a number of ejection openings are implemented in high density and furthermore, a plurality of ejecting portions are provided which correspond to inks of plural colors. However, since there are various kinds of ink ejection methods applied to the ink jet printing apparatus, the invention can certainly be applied also to the ink jet printing head of a type using electromechanical energy conversion elements such as piezo elements, for example.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2005-125197 filed Apr. 22, 2005, which is hereby incorporated by reference herein.

What is claimed is:

1. An ink jet printing head attachable/detachable to/from an ink jet printing apparatus, comprising:

a connection terminal group comprising a plurality of connection terminals for carrying out an electrical connection by contacting a plurality of connection terminals in the ink jet printing apparatus when the head is mounted on the ink jet printing apparatus; and a print element substrate having ink ejection openings and elements for generating energy to eject ink from the ink ejection openings in response to a drive signal transmitted from the ink jet printing apparatus via the connection terminals of the connection terminal group, wherein the connection terminal group is arranged in a planar area, wherein the connection terminals positioned in at least three corners of a terminal arranging area of the connection terminal group arranged in the planar area are used as detection terminals for detecting an electrical connection state between the ink jet head and the ink jet printing apparatus, and wherein at least one of the connection terminals positioned in the at least three corners is a connection terminal for the drive signal.

2. An ink jet printing head as claimed in claim 1, wherein the drive signal is any one of a signal for determining a drive waveform of the elements, a drive control signal for the elements in accordance with printing data and a clock signal regulating an operation on a circuit which carries out drive control of the elements.

3. An ink jet printing head as claimed in claim 1, wherein the circuit which carries out drive control of the elements comprises a shift register for retaining drive control signals for the elements in accordance with the printing data, and wherein the drive signal is a latch signal for latching the drive control signals retained in the shift register.

4. An ink jet printing head attachable/detachable to/from an ink jet printing apparatus, comprising:

a connection terminal group comprising a plurality of connection terminals for carrying out an electrical connection by contacting a plurality of connection terminals in the ink jet printing apparatus when the head is mounted on the ink jet printing apparatus; and a print element substrate having ink ejection openings and elements for generating energy to eject ink from the ink ejection openings in response to a drive signal transmitted from the ink jet printing apparatus via the connection terminals of the connection terminal group, wherein the connection terminal group is arranged in a planar area, wherein the connection terminals positioned in at least three corners of a terminal arranging area of the connection terminal group arranged in the planar area are used as detection terminals for detecting an electrical connection state between the ink jet head and the ink jet printing apparatus, wherein at least one of the connection terminals positioned in the at least three corners is for a type of signal different from the drive signal, and wherein the different type of signal is a signal related to a temperature sensor provided in the ink jet printing head for carrying out temperature detection of the ink jet printing head.

5. An ink jet printing head as claimed in claim 4, wherein the temperature sensor comprises a diode sensor provided on the print element substrate.

6. An ink jet printing head attachable/detachable to/from an ink jet printing apparatus, comprising:

a connection terminal group comprising a plurality of connection terminals for carrying out an electrical connection by contacting a plurality of connection terminals in the ink jet printing apparatus when the head is mounted on the ink jet printing apparatus; and a print element substrate having ink ejection openings and elements for generating energy to eject ink from the ink ejection openings in response to a drive signal transmitted from the ink jet printing apparatus via the connection terminals of the connection terminal group, wherein the connection terminal group is arranged in a planar area, wherein the connection terminals positioned in at least three corners of a terminal arranging area of the connection terminal group arranged in the planar area are used as detection terminals for detecting an electrical connection state between the ink jet head and the ink jet printing apparatus, wherein the print element substrate comprises a circuit for confirming connection states between the connection terminals positioned in the at least three corners and connection terminals corresponding thereto in the ink jet printing apparatus, and wherein the connection terminal group includes an output terminal for a signal outputted from the circuit for confirming the connection state.

7. An ink jet printing head attachable/detachable to/from an ink jet printing apparatus, comprising:

a connection terminal group comprising a plurality of connection terminals for carrying out an electrical connection by contacting a plurality of connection terminals in the ink jet printing apparatus when mounting on the ink jet printing apparatus;

a print element substrate having ink ejection openings and elements for generating energy to eject ink from the ink ejection openings in response to a drive signal transmitted from the ink jet printing apparatus via the connection terminals of the connection terminal group; and an ink tank for containing ink to be supplied to the print element substrate, the ink tank being integrated with the ink jet printing head, wherein the print element substrate is disposed on one of surfaces of the ink jet printing head, wherein the connection terminal group is arranged in a planar area on a side surface of the ink jet printing head assuming that the surface on which the print element substrate is disposed is a bottom surface of the ink jet printing head area, and wherein the connection terminals positioned in at least three corners of a terminal arranging area of the connection terminal group arranged in the planar area are used as detection terminals for detecting an electrical connection state between the ink jet head and the ink jet printing apparatus.

8. An ink jet printing apparatus to/from which an ink jet printing head is attachable/detachable, comprising:

a connection terminal group in a printing apparatus side, the connection terminal group comprising a plurality of connection terminals for carrying out an electrical connection with the printing head by contacting a plurality of connection terminals in a printing head side when the ink jet head is mounted on the ink jet printing apparatus; and a notifying unit for notifying of an abnormality, wherein the connection terminal group in the printing apparatus side is arranged in a planar area, wherein the connection terminals positioned in at least three corners of a terminal arranging area of the printing apparatus side connection terminal group arranged in the planar area are used as detection terminals for detecting an electrical connection state between the ink jet printing head and the ink jet printing apparatus, and wherein the notifying unit notifies of an abnormality in a case where a contact between one of the connection terminals positioned in the at least three corners and a connection terminal corresponding thereto in the printing head side is not detected.

* * * * *